US005709159A

United States Patent [19]

Mercer et al.

[11] Patent Number: 5,709,159

[45] Date of Patent: Jan. 20, 1998

[54] DELIVERY ACCESS DEVICE

[75] Inventors: Scott Alan Mercer, Hanoverton; David Andrew Peters, Tallmadge; Carl Nelson Leonhardt, Massillon, all of Ohio

[73] Assignee: InterBold, North Canton, Ohio

[21] Appl. No.: 744,898

[22] Filed: Nov. 8, 1996

Related U.S. Application Data

[63] Continuation of Ser. No. 237,086, May 3, 1994, abandoned.

[51] Int. Cl.[6] ..... E05G 7/00

[52] U.S. Cl. ..... 109/2; 109/5; 109/6; 109/12; 109/19

[58] Field of Search ..... 109/2, 5–8, 10–21, 109/21.5, 49.5, 64, 67, 68

[56] References Cited

U.S. PATENT DOCUMENTS

| | | | |
|---|---|---|---|
| 2,912,066 | 11/1959 | Ellithorpe | 109/19 |
| 3,957,173 | 5/1976 | Roudebush | 109/68 X |
| 4,251,009 | 2/1981 | McLaughlin et al. | 109/19 X |
| 4,340,150 | 7/1982 | Guibord et al. | 221/21 |
| 4,393,788 | 7/1983 | Campbell et al. | 109/2 |
| 4,429,639 | 2/1984 | Burchart | 109/19 |
| 4,655,368 | 4/1987 | Bateman et al. | 109/64 X |
| 4,890,766 | 1/1990 | Martin et al. | 109/67 X |
| 5,172,643 | 12/1992 | Koshida et al. | 109/10 |

FOREIGN PATENT DOCUMENTS

| | | | |
|---|---|---|---|
| 0034502 | 8/1981 | European Pat. Off. | 109/10 |
| 0 329 034 A1 | 8/1989 | European Pat. Off. . | |
| 1523352 | 3/1968 | France | 109/15 |
| 3281885 | 12/1991 | Japan | 109/10 |
| 8401321 | 11/1985 | Netherlands | 109/19 |
| 2026220 | 1/1980 | United Kingdom . | |
| 2171394 | 8/1986 | United Kingdom | 109/10 |
| 2213870 | 8/1989 | United Kingdom | 109/64 |

*Primary Examiner*—Lloyd A. Gall
*Attorney, Agent, or Firm*—D. Peter Hochberg; Mark Kusner

[57] ABSTRACT

A delivery access device attachable to a currency dispenser comprising: a mounting plate attachable to the currency dispenser, the plate having a money dispensing slot; two separate and independent barrier members mounted within the money dispensing slot, each barrier member having a first position where it is retracted and a second position where it is extended to obstruct access to the slot; two separate and independent actuators, a first of which is for moving one of the barrier members between its retracted and extended position, and a second of which is for moving a second of the barrier members between its retracted and extended position; and an electrical connector for connecting the actuators to the circuitry of the currency dispenser.

14 Claims, 5 Drawing Sheets

DELIVERY ACCESS DEVICE

This is a continuation of application Ser. No. 08/237,086 filed on May 3, 1994, now abandoned.

FIELD OF THE INVENTION

The present invention relates generally to currency dispensing machines, and more particularly, to a delivery access device for regulating access to the currency delivery slot of a currency dispensing machine.

BACKGROUND OF THE INVENTION

Currency dispensing machines are often used in place of cash drawers in banks and other financial institutions in order to help reduce human error, as well as the possibility of theft. Such machines dispense cash from a currency storage location securely located within the currency dispensing machine when transaction information is entered by a teller, typically by means of a computer keyboard. In this respect, in order to receive cash, transaction information must be entered by the teller into the memory of the currency dispensing machine which creates a record of each transaction.

Generally, one currency dispensing machine is used to service two tellers. In such situations, the machine is usually positioned between the two tellers who sit, respectively, on the left and right of the machine. Cash is dispensed to the tellers through a slot in the currency dispensing machine, which slot is generally centrally located between the two tellers. Each teller works independently on separate and different transactions, and must generally reach towards the slot to receive cash for a specific transaction. To avoid confusion, some currency machines known heretofore include devices to indicate for which teller each machine transaction was meant. One such device is comprised of indicator lights which are controlled by the operating circuitry of the currency dispensing machine. The lights are generally located on the currency dispensing machine adjacent each teller, and create a visual signal. A problem with indicator lights is that the tellers often become desensitized to them. In this respect, teller work requires accuracy, concentration and speed, and in order to see the indicator light, a teller must look up from his or her work station. Accordingly, it is not uncommon for the teller to enter the transaction information and then simply reach for the money, thereby ignoring the indicator lights.

Physical barriers have also been incorporated on currency dispensing machines to indicate for which teller a specific transaction is meant. The barrier is typically an elongated one-piece member which is pivotally mounted within the dispensing slot in the currency dispensing machine. The elongated barrier member is pivotally mounted in the slot by a pin such that the barrier member can pivot or rock wherein one end of the barrier member extends outward at one end of the dispensing slot to create a physical barrier thereat. This barrier thus provides a physical obstacle to one teller when currency is intended for the other teller. For example, when currency is to be dispensed for the teller positioned on the right of the dispenser, the barrier member is pivoted so that it protrudes or projects outward at the left end of the dispensing slot, creating a physical barrier to the teller positioned on the left. Generally, such rocker members were an integral component of the currency dispensing machine and were controlled by electrical circuitry of the dispensing machine.

While the aforementioned physical barrier proved to be more effective as an indicator to tellers using a currency dispensing machine, it still had shortcomings. In one regard, because the barrier member pivots about a central axis, it can only provide a barrier at one end of the dispensing slot for any transaction. In other words, such a structure is basically limited to two-teller operations. Further, the barrier arrangement as described above was typically an integral component of the currency dispenser inserted during the manufacturing process.

The present invention overcomes these and other problems and provides a delivery access device for a currency dispensing machine, which is retrofittable to an existing currency dispenser and which device includes separate and independently-operable physical barriers.

SUMMARY OF THE INVENTION

In accordance with the present invention there is provided a delivery access device for regulating access to a dispensing slot of a currency dispensing machine. The device includes a housing having an elongated opening therethrough, which opening is alignable with a cash dispensing slot in the currency dispensing machine. An independent and separate barrier member is provided at each distal end of the elongated opening. Each barrier member is independently and separately movable between a first position wherein the barrier member is fully retracted and a second position wherein the barrier is fully extended. In the second position, the barrier member creates a physical obstruction at the respective end of the dispensing opening.

In accordance with another embodiment of the invention there is provided a delivery access device for regulating access to a dispensing slot of a currency dispensing machine wherein the device has two separate and independent barrier members. Actuator means are provided for moving each barrier member, respectively, from a retracted position to an extended position. When in its extended position, the independent barrier member blocks access to the currency dispensing slot. Electrical connector means are provided for connecting the actuator means to the electrical circuitry of the currency dispensing machine whereby the actuator means moves each separate and independent barrier member in response to signals from the circuitry.

In accordance with another embodiment of the invention there is provided a self-contained delivery access device for regulating access to a dispensing slot of a currency dispensing machine. In this embodiment, the delivery access device has a housing attached to a fascia, defining a cavity therebetween. Two separate and independent barrier members, two separate and independent actuators and electrical connecting means are contained within the cavity. The connecting means connect the actuators to the electrical circuitry of the currency dispensing machine and each actuator is connected to one of the barrier members. Each actuator moves the barrier member to which it is connected from a retracted position wherein the barrier member is contained within the cavity to an extended position in response to signals from the circuitry. The barrier member extends through a slot in the fascia when in its extended position thereby obstructing access to the slot.

As will be appreciated, because each barrier member moves independently of the other, both barrier members Can either be in the fully-retracted or in the fully-extended positions. In a preferred embodiment of the invention, a fascia plate is positioned over the mounting plate and barrier members and fastened to the mounting plate to create a self-contained, one-piece assembly which is then retrofitted to the cash dispensing machine.

It is an object of the present invention to provide a delivery access device for regulating access to currency dispensed from a currency dispensing machine.

Another object of the present invention is to provide a delivery access device as described above which may be used on an existing currency dispensing machine.

Another object of the present invention is to provide a delivery access device as described above having separate and independently operable barrier members.

Another object of the present invention is to provide a delivery access device as described above wherein separate and independently operable actuator means are provided for each of the barrier members.

Another object of the present invention is to provide a delivery access device as described above which is a fully self-contained unit.

Another object of the present invention is to provide a delivery access device as described above which includes a housing which contains the actuator means and barrier members.

Another object of the present invention is to provide a delivery access device as described above including electrical means for connecting the device to the internal circuitry of a currency dispenser.

These and other objects and advantages will become apparent from the following description of a preferred embodiment of the invention taken together with the accompanying drawings.

BRIEF DESCRIPTION OF THE DRAWINGS

The invention may take form in certain parts and arrangement of parts, a preferred embodiment of which will be described in detail in the specification and illustrated in the accompanying drawings wherein.

DETAILED DESCRIPTION OF A PREFERRED EMBODIMENT

Figure 1A:
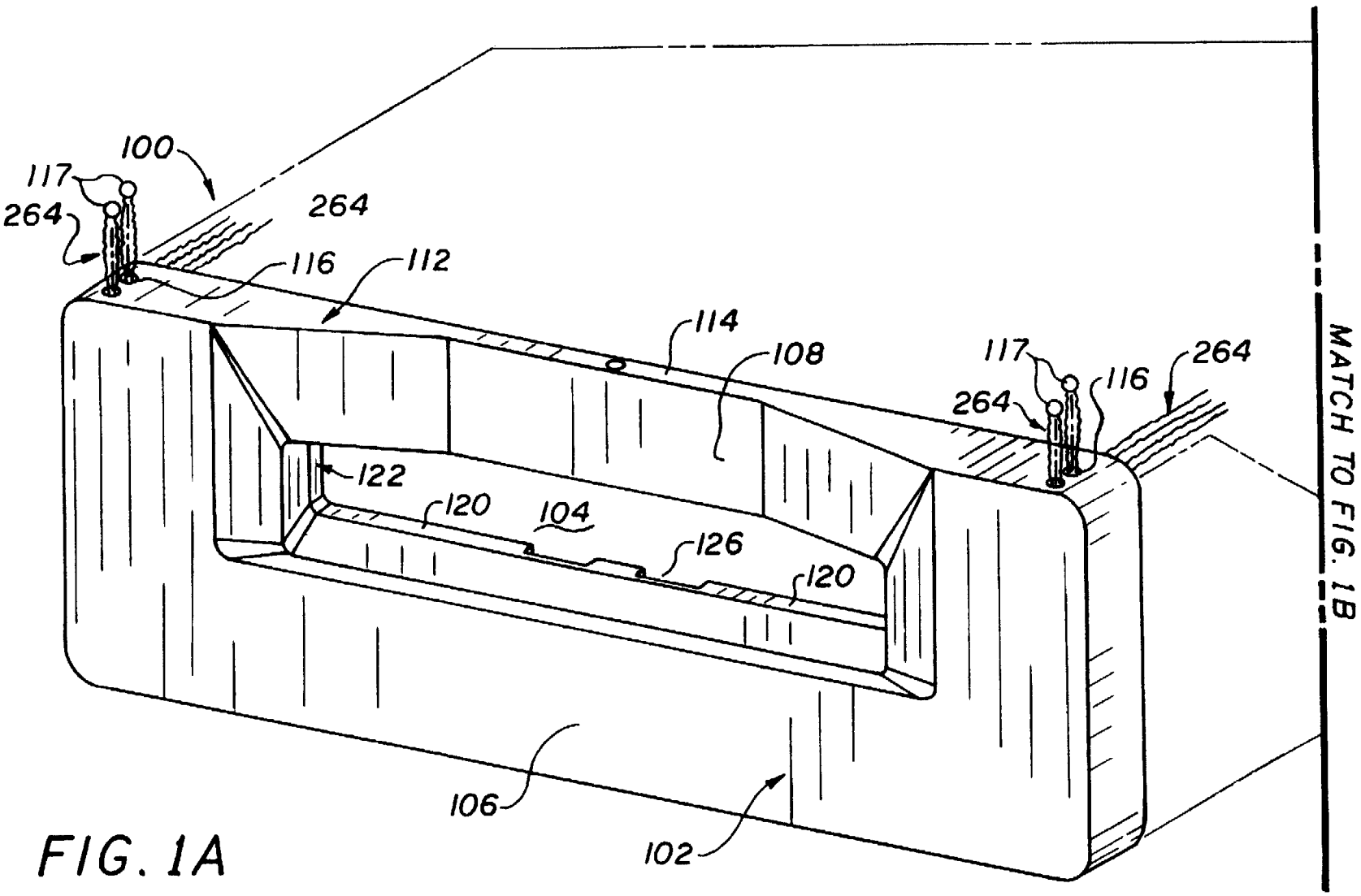
FIGS. 1A and 1B are exploded, front perspective views of a delivery access device made in accordance with the teachings of the present invention.
Figure 1B:
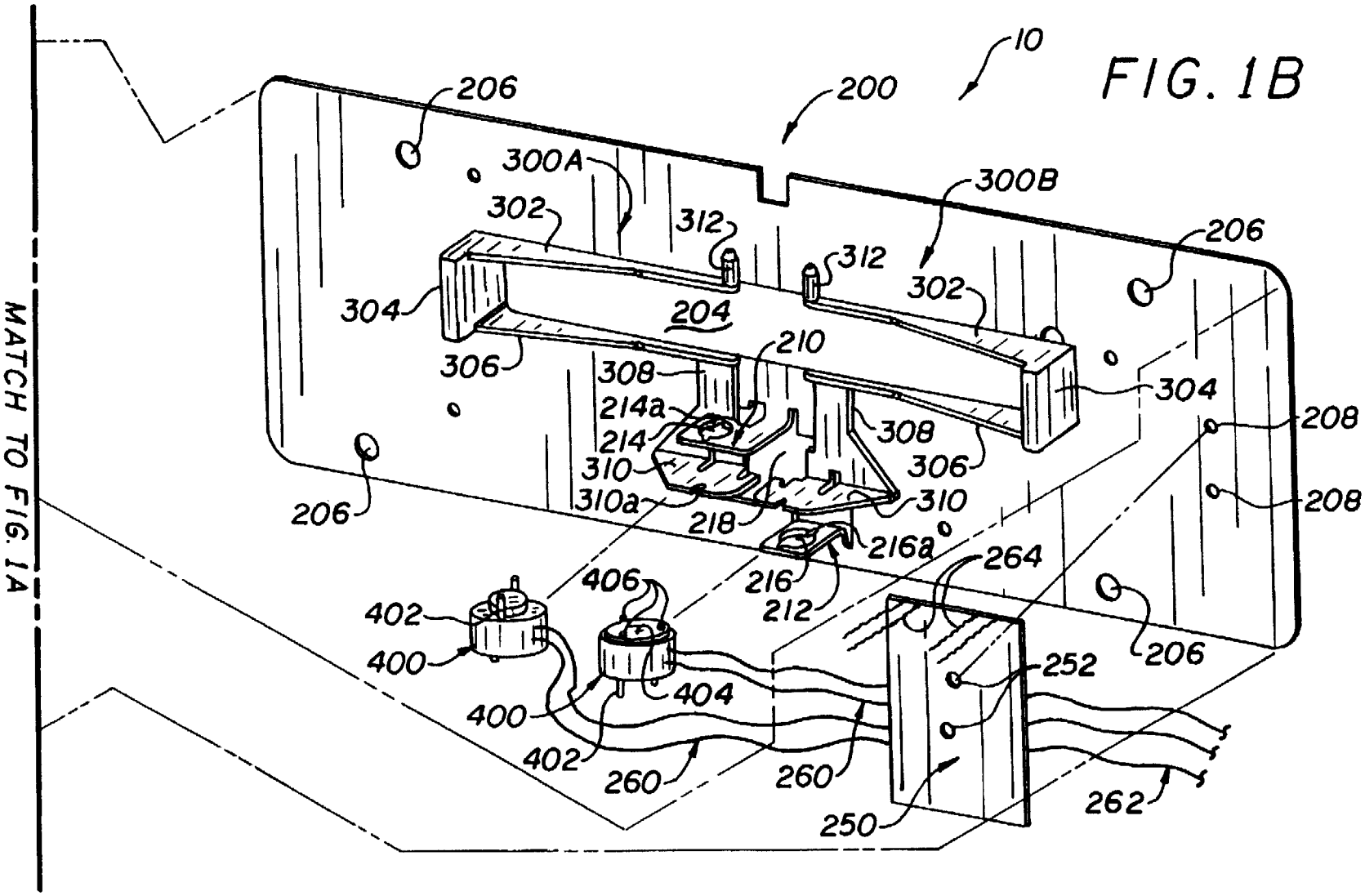

Referring now to the drawings wherein the showings are for the purpose of illustrating a preferred embodiment of the invention only and not for the purpose of limiting same, FIGS. 1A and 1B show a delivery access device 10 in accordance with the present invention for use with a conventional currency dispenser. Delivery access device 10 is generally comprised of a fascia 100, a mounting plate 200, two barrier members 300A and 300B, and barrier member drive elements 400.

Fascia 100 is generally rectangular in shape, and in the embodiment shown includes a front panel, designated 102 in the drawings. Panel 102 has a flat outer portion 106 and an inner portion 108 which is multi-faceted with the surface of each facet generally sloping inward toward an elongated, centrally located slot 104, thus creating a funnel-like configuration. A flat edge section 112 is formed along the perimeter of panel 102 and extends in a direction generally perpendicular thereto. The upper portion of edge section 112 includes a thin, attenuated strip 114 at the center thereof. Apertures 116 are provided at the distal ends of the upper portion of edge section 112 to receive light-emitting diodes (LEDs) 117, best seen in FIG. 2B.

Figure 2A:
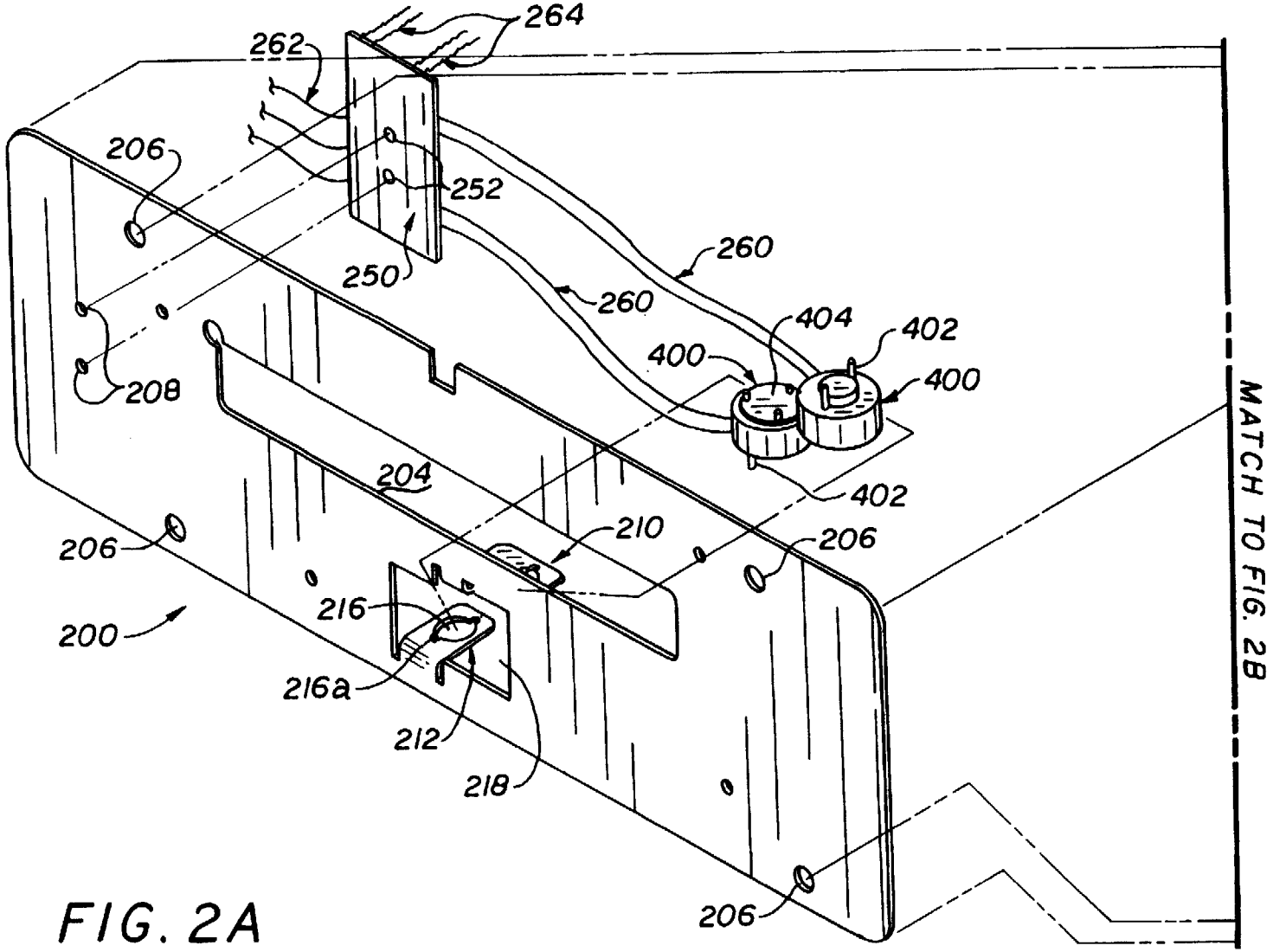
FIGS. 2A and 2B are exploded, rear perspective views of the delivery access device shown in FIGS. 1A and 1B.
Figure 2B:
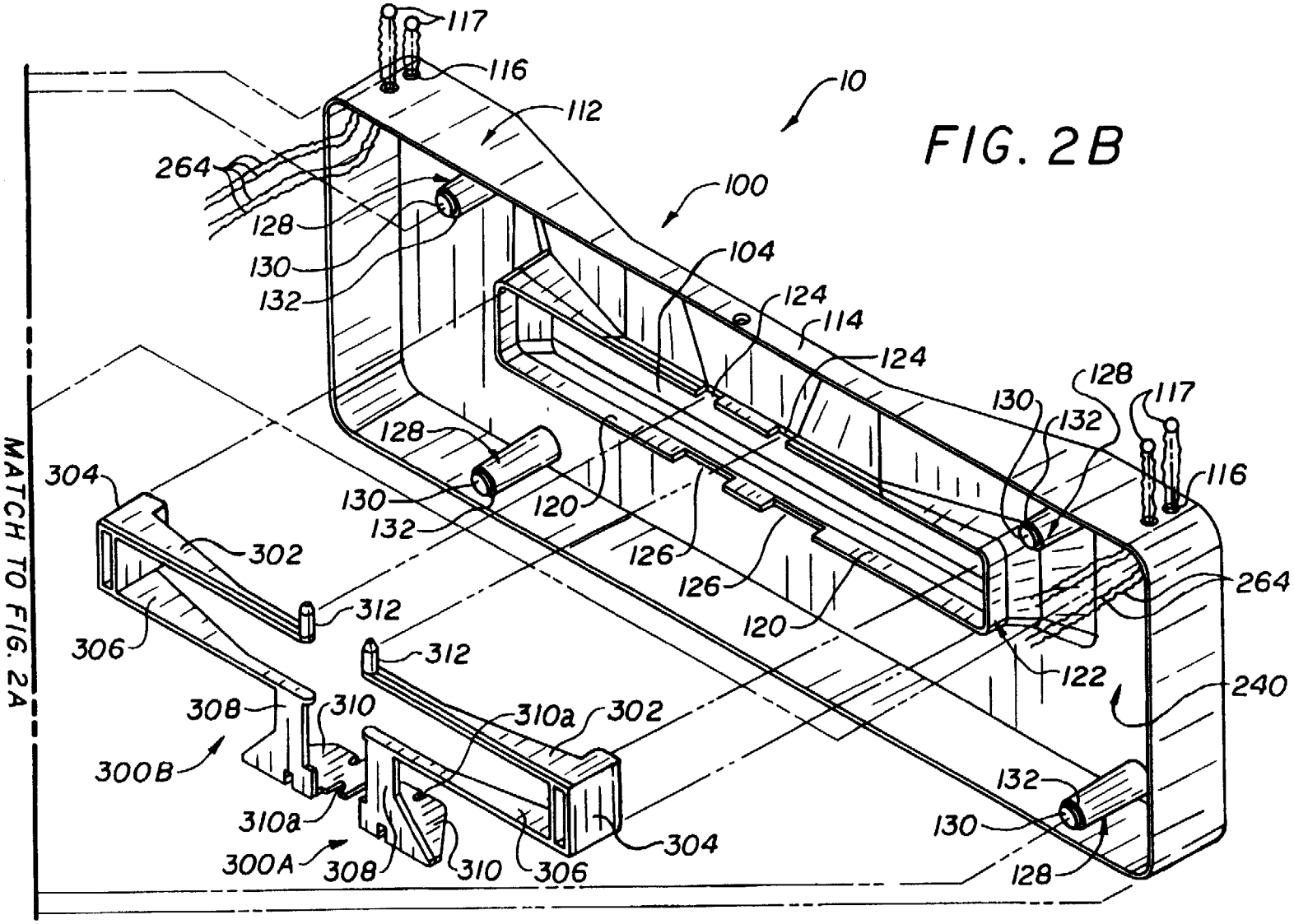

Turning now to FIG. 2B, a view of the interior of fascia 100 is shown. A flange 120 extends generally perpendicular to panel 102 about the periphery of slot 104 to create a passage or chute 122. A pair of first notches 124 is formed in the upper portion of flange 120 and a second pair of larger notches 126 is formed in the lower portion of flange 120. Four tubular posts 128 extend from the interior surface of panel 102. Each post 128 defines an axially aligned bore 130, and includes a stepped end 132. Posts 128 are preferably located, respectively, near the four corners of fascia 100.

Turning now to FIGS. 1B and 2A, mounting plate 200 is best seen. Plate 200 is generally flat and rectangular in shape, and is preferably formed of sheet metal. Plate 200 has an elongated, rectangular opening 204 formed centrally therein. A circular aperture 206 is formed in each of the four corners of mounting plate 200. Apertures 206 are positioned to be in registry with tubular posts 128 in fascia 100 whereby plate 200 and fascia 100 can be joined. In this respect, apertures 206 are dimensioned to receive stepped ends 132 of posts 128. A cavity 240 is defined between fascia 100 and plate 200. Smaller circular apertures 208 are formed near one longitudinal end of mounting plate 200.

A pair of mounting brackets 210 and 212 extend generally perpendicularly on one side of plate 200. In the embodiment shown, brackets 210 and 212 are preferably integrally formed as part of mounting plate 200, leaving a generally rectangular opening 218 beneath elongated slot 204. Mounting bracket 210 includes a mounting aperture 214 and mounting bracket 212 includes a mounting aperture 216. Each aperture 214, 216 includes radially extending slots, designated 214*a*, 216*a* respectively.

Referring now to FIGS. 1B and 2B, barrier members 300A and 300B are best seen. In the embodiment shown, barrier members 300A and 300B are generally mirror images of each other and therefore only one shall be described in detail, it being understood that such description applies equally to the other. Each barrier member 300A, 300B has an elongated upper portion 302, and an elongated lower portion 306. A barrier portion 304 connects one end of upper portion 302 to one end of lower portion 306, to define a generally U-shape configuration. A leg 308 extends perpendicularly from lower portion 306 and is connected to a base 310. Each base 310 is generally flat and includes three (3) spaced-apart notches designated 310*a* in the drawings for connection with drive elements 400, which is discussed in greater detail below. A pin 312 extends from the free end of portion 302.

In the embodiment shown, barrier members 300A, 300B are generally positioned with chute or passage 122 defined by flange 120 of fascia 100. More specifically, pin 312 of barrier members 300A and 300B is disposed within notch 124 in flange 120, and leg 308 of barrier 300A, 300B is disposed within notch 126. In this respect, pin 312 and leg 308 are confined within notches 124, 126, respectively, by plate 200. In this position, barrier members 300A and 300B are dimensioned to be positioned within cavity 240, which is defined by fascia 100 and plate 200. Base 310 of the U-shaped barrier member 300A (shown on the left in FIG. 1B) is positioned beneath and spaced a predetermined distance from mounting bracket 210 and the base 310 of the U-shaped barrier member 300B (shown on the right in FIG. 1B) is positioned above and spaced from mounting bracket 212. The spacing between the respective bases 310 and brackets 210 and 212 define two separate mounting sites. A barrier member drive element 400 is positioned in each mounting site.

In the embodiment shown, drive elements 400 are comprised of solenoids which are generally cylindrical in shape. A pair of locating pins 402 extend from one end of drive element 400, and a rotatable disc 404 having three (3) spaced-apart drive pins 406 is provided at the other end of drive element 400. Drive elements 400 are received, and set, within apertures 214, 216 of brackets 210, 212 respectively, with locating pins 402 disposed within slots 214*a*, 216*a*. In this position, drive pins 406 are received within notches 310*a* of bases 310 of barrier members 300A, 300B. In the embodiment shown, drive elements 400 are identical, and brackets 210, 212 are located such that one drive element 400 is inverted relative to the other, as best shown in FIG. 2A. According to the present invention, each barrier member 300A, 300B is independently movable, by its associated drive element 400, between a retracted position wherein barrier member 300A or 300B is generally disposed within passage 122, and an extended position wherein barrier member 300A or 300B projects above the surface of flat, outer panel portion 106.

A circuit board 250 is provided for mounting to plate 200. Circuit board 250 is generally flat and rectangular in shape and includes two small vertically-aligned circular apertures 252 located near the center of plate 250. Apertures 252 align with apertures 208 in mounting plate 200, as is best seen in FIG. 2A. Circuit board 250 includes electrical circuitry (not shown) for controlling access device 10. Circuit board 250 is affixed to mounting plate 200 by conventional fasteners extending through apertures 252 into apertures 208 of plate 200. Electrical leads 260 connect drive elements 400 to circuit board 250. Electrical leads 262 connect circuit board 250 to the internal circuitry of the currency dispensing machine to which it is attached. Electrical leads 264 connect circuit board 250 to LED's 117.

Referring now to the operation of access device 10, as shown above, device 10 is a self-contained unit. In this respect, it can be mounted to an existing currency dispensing apparatus by positioning the device 10 on the currency dispensing apparatus with slot 104 of device 10 aligned with the currency dispensing slot of the currency dispensing apparatus. The electrical leads from device 10 are attached to the internal control circuitry of the currency dispensing apparatus, to pick up signals for controlling the barrier members 300.

Figure 3A:
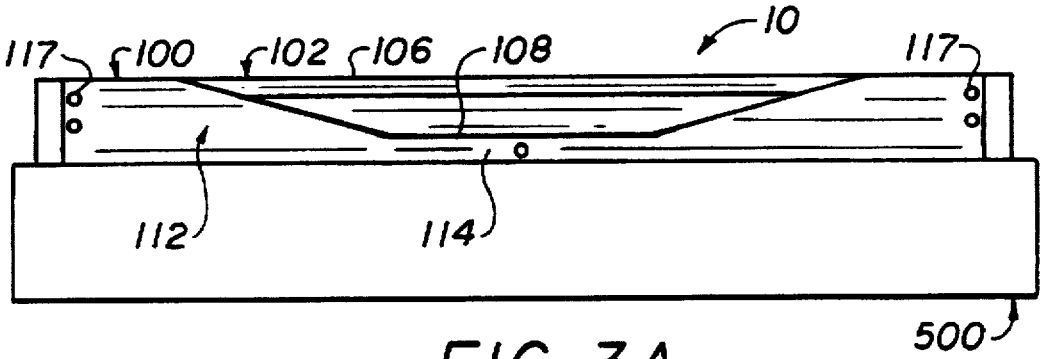
FIGS. 3A, 3B, 3C and 3D are top plan views of the assembled delivery access device mounted to a currency dispensing machine showing four operating positions.

Turning now to FIGS. 3A through 3D, the operation of delivery access device 10 is shown. FIGS. 3A–3D are top plan views of delivery access device 10 shown attached to the front of a currency dispensing apparatus, designated 500. FIG. 3A illustrates a first operating position of the present invention where both barrier members 300 are in a retracted position and, therefore, are not visible since they are contained within the cavity between fascia 100 and plate 200.

Figure 3B:
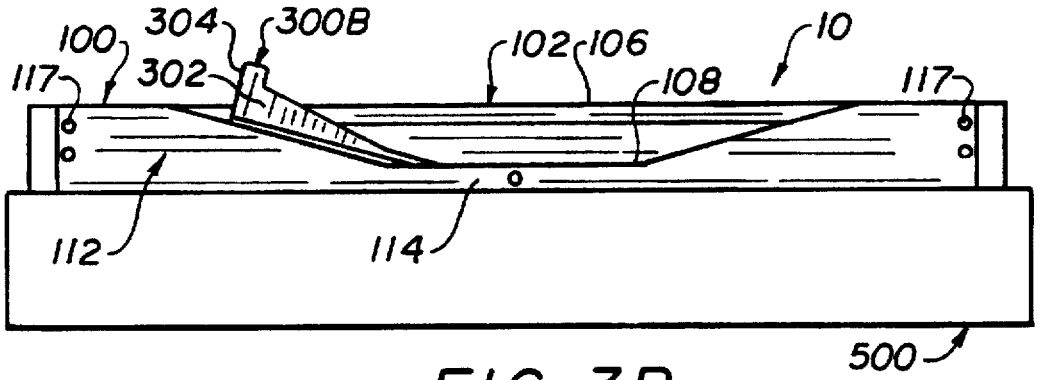

FIG. 3B illustrates a second operating position of a delivery access device 10, wherein the right side barrier member 300A is in a retracted position and the left side barrier member 300B is in an extended position creating a physical barrier and obstructing access to the slot by the operator positioned on the left side of the currency dispensing apparatus. Delivery access device 10 would assume this position, when the teller on the right side of the currency dispensing apparatus has entered a transaction into the logic of the currency dispenser requesting cash. When the cash is dispensed through slot 104 the circuitry of the currency dispensing machine activates a solenoid 400 which moves the left side barrier member 300B to its extended position. Thus, access to slot 104 by the teller positioned on the left is physically blocked by the barrier portion 304 of extended member 300B.

Figure 3C:
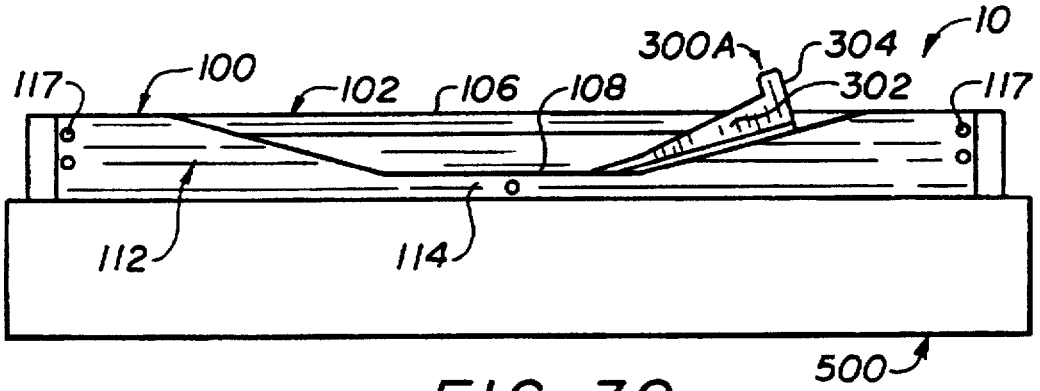
Figure 3D:
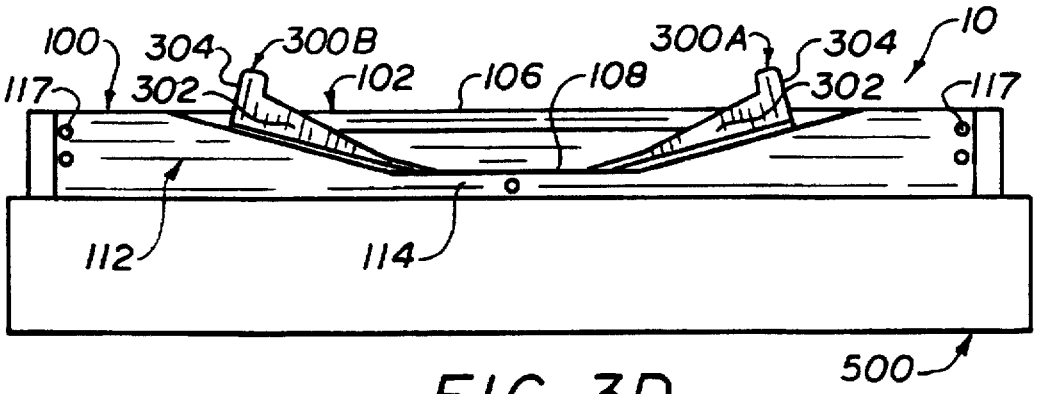

FIG. 3C illustrates a third operating condition of the present invention wherein the barrier member 300B on the left side of the currency dispensing apparatus is in its retracted position and the barrier member 300A on the right side of the currency dispensing apparatus is in its extended position thus creating a physical barrier and obstructing access to slot 104 by the teller positioned on the right in the drawings. FIG. 3D illustrates a fourth operating condition of the present invention wherein both barrier members 300 are in the extended position thereby physically blocking access to slot 104 by the tellers located on both the left side and on the right side of the currency dispensing apparatus. This position may be assumed when the currency which is dispensed is for a third teller or operator.

The present invention has been described with respect to a preferred embodiment. Modifications and alterations to the device heretofore described will occur to others upon a reading and understanding of the present specification. For example, it will be appreciated that the barrier members need not be positioned within the elongated slot of the mounting plate, but need only be positioned relative to the slot so that they create physical barriers to the operator's hands.

It is intended that any and all such modifications and alterations to the present invention be included insofar as they come within the scope of the patent as claimed or the equivalents thereof.

Having described the invention, the following is claimed:

1. A self-contained device for attachment to a currency dispensing machine for regulating access to a dispensing slot of the currency dispensing machine, said device comprising:

a housing mountable to a currency dispensing machine, a slot through said housing alignable with the dispensing slot in said currency dispensing machine, a first barrier member and a second barrier member mounted within said housing, said first and second barrier members each being generally U-shaped and independently rotatable about an axis between a first position wherein said barrier member obstructs access to a portion of said dispensing slot and a second position wherein said barrier member does not obstruct access to said dispensing slot, said first barrier member being rotatable about a first axis and said second barrier member being rotatable about a second axis, first and second actuators within said housing for initiating movement of said first and second barrier members, and electrical connections for connecting said device to an operating circuit of said currency dispensing machine.

2. A device as described in claim 1 wherein said first barrier member is disposed to obstruct access to one end of said dispensing slot and said second barrier member is disposed to obstruct access to the other end of said dispensing slot.

3. A device for regulating access to a money-dispensing slot of a currency dispensing mechanism, said currency dispensing mechanism controlled by electric circuitry, said device comprising:

an elongated first barrier member having one end pivotally mounted for rotation about a fixed first axis and a free end, said barrier member being movable between a retracted position and an extended position wherein said free end of said first barrier member obstructs access to one side of said slot, an elongated second barrier member, separate and independent from said first member, said second barrier member having one end pivotally mounted for rotation about a fixed second axis and a free end, said second axis being non-collinear with said first axis, said barrier member being movable between a retracted position and an extended position wherein said free end of said second barrier member obstructs access to the other end of said slot, first actuator means attached to said first barrier member and second actuator means attached to said second barrier member, said first and second actuator means for moving said first barrier member between said retracted position and said extended position independent of said second barrier member, and for moving said second barrier member between said retracted position and said extended position independent of said first barrier member, a housing enclosing said barrier members and said actuator means, said housing being attachable to said currency dispensing mechanism, and electrical connector means for connecting said actuator means to the circuitry of said currency dispensing mechanism, said actuator means moving said first barrier member and said second barrier member, respectively, in response to electric signals from said circuitry.

4. A device as described in claim 3 wherein said device includes a mounting plate attachable to said currency dispensing mechanism, said plate having an elongated slot which aligns with said money-dispensing slot, said first barrier member and said second barrier member being mountable to said mounting plate.

5. A device as described in claim 4 wherein said device includes a fascia mounted to said mounting plate, said fascia having an opening which aligns with said elongated slot, said first barrier member and said second barrier member being disposed between said fascia and said mounting plate, said first barrier member and said second barrier member being contained within said opening when in their respective retracted positions, said first barrier member and said second barrier member extending from said opening and obstructing access thereto when in their respective extended positions.

6. A device as described in claim 5 wherein said fascia has light-emitting diodes (LEDs) attached thereto, said LEDs connected to said electrical connector means and indicating the position of said barrier members.

7. A device as described in claim 3 wherein said actuator means includes a first actuator and a second actuator, said first actuator for moving said first barrier member between said retracted position and said extended position, said second actuator for moving said second barrier member between said retracted position and said extended position.

8. A device as described in claim 3 wherein said first barrier member pivots about a first axis and said second barrier member pivots about a second axis, said first axis and said second axis being separate.

9. A device for regulating access to a money-dispensing slot of a currency dispensing mechanism, said currency dispensing mechanism controlled by electric circuitry, said money-dispensing slot having a first longitudinal end and a second longitudinal end, said device comprising:

a generally U-shaped, elongated first barrier member pivotally mounted at one end for rotation about a first fixed axis relative said first longitudinal end of said slot, said first barrier member movable between a retracted position and an extended position wherein it obstructs access to said slot, a generally U-shaped, elongated second barrier member, separate from said first barrier member, pivotally mourned at one end for rotation about a second fixed axis relative said second longitudinal end of said slot, said second barrier member movable between a retracted position and an extended position wherein it obstructs access to said slot, a first actuator attached to said first barrier member for moving said first barrier member about said first fixed axis between said retracted position and said extended position, a second actuator attached to said second barrier member for moving said second barrier member about said second fixed axis between said retracted position and said extended position, electrical connector means for connecting said first actuator and said second actuator to the circuitry of the currency dispensing mechanism whereby said first actuator moves said first barrier member and said second actuator moves said second barrier member in response to electrical signals from said circuitry.

10. A device as described in claim 9 wherein said device includes a mounting plate attachable to the currency dispensing mechanism, said plate having a slot alignable with said money-dispensing slot.

11. A device as described in claim 10 wherein there is a fascia attached to said mounting plate, said fascia having an opening dimensioned to align with said money-dispensing slot wherein said barrier members are disposed between said fascia and said mounting plate, said barrier members being contained within said opening in said fascia when said members are in their respective retracted position, said members extending from said opening when said members are in their respective extended position.

12. A device as described in claim 11 wherein said fascia has light-emitting diodes (LEDs) attached thereto, said LEDs connected to said electrical connector means and indicating said positions.

13. A device for regulating access to a money-dispensing slot of a currency dispensing machine comprising:

a mounting plate attachable to the currency dispensing machine, said plate having an elongated slot, said elongated slot having a first longitudinal end and a second longitudinal end, a fascia attached to said mounting plate to form a housing having an internal cavity, said fascia having an opening which aligns with said elongated slot, a first U-shaped barrier member disposed within said cavity between said mounting plate and said fascia, said first member mounted relative said first longitudinal end of said elongated slot, said first member movable between a retracted position wherein it is contained within the opening in said fascia and an extended position wherein it extends from said opening and obstructs access to said elongated slot, a second U-shaped barrier member disposed within said cavity between said mounting plate and said fascia, said second member mounted relative said second longitudinal end of said elongated slot, said second member movable between a retracted position wherein it is contained within the opening in said fascia and an extended position wherein it extends from said opening and obstructs access to said elongated slot, a first actuator within said cavity attached to said first barrier member for rotating said first barrier member about a first fixed axis between said retracted position and said extended position, a second actuator within said cavity attached to said second barrier member for rotating said second barrier member about a second fixed axis between said retracted position and said extended position, a first operating position wherein said first barrier member is retracted and said second barrier member is extended, a second operating position wherein said first barrier member is extended and said second barrier member is retracted, a third operating position whereby said first barrier member and said second barrier member are retracted and a fourth operating position wherein said first barrier member and said second barrier member are extended, and electrical connector means extending from said housing for connecting said first actuator and said second actuator to circuitry within the currency dispensing machine whereby the device is movable to either said first, said second, said third or said fourth operating position in response to electric signals from said circuitry.

14. A device as described in claim 13 wherein said fascia has light-emitting diodes (LEDs) attached thereto, said LEDs connected to said electrical connector means and indicating said first, said second, said third or said fourth operating positions.

* * * * *